US008081900B2

(12) United States Patent
Noh

(10) Patent No.: US 8,081,900 B2
(45) Date of Patent: Dec. 20, 2011

(54) DEVELOPING APPARATUS AND IMAGE FORMING APPARATUS HAVING THE SAME

(75) Inventor: Joo-hwan Noh, Yongin-si (KR)

(73) Assignee: SAMSUNG Electronics Co., Ltd., Suwon-si (KR)

( * ) Notice: Subject to any disclaimer, the term of this patent is extended or adjusted under 35 U.S.C. 154(b) by 392 days.

(21) Appl. No.: 11/684,324

(22) Filed: Mar. 9, 2007

(65) Prior Publication Data

US 2008/0080891 A1 Apr. 3, 2008

(30) Foreign Application Priority Data

Sep. 28, 2006 (KR) ..... 10-2006-0095103

(51) Int. Cl.
*G03G 21/16* (2006.01)

(52) U.S. Cl. ..... 399/111; 399/114

(58) Field of Classification Search ..... 399/109, 399/111, 113, 119, 120
See application file for complete search history.

(56) References Cited

U.S. PATENT DOCUMENTS 5,583,613 A * 12/1996 Kobayashi et al. ..... 399/111
5,809,374 A * 9/1998 Tsuda et al. ..... 399/111
6,721,520 B2 * 4/2004 Higeta et al. ..... 399/109
2006/0045563 A1 3/2006 Kim et al.

FOREIGN PATENT DOCUMENTS

JP 4-280261 10/1992
JP 8-160841 6/1996

OTHER PUBLICATIONS

Chinese Office Action Issued Jun. 12, 2010 in CN Application No. 200710137362.5.

* cited by examiner

*Primary Examiner* — Hoang Ngo
(74) *Attorney, Agent, or Firm* — Stanzione & Kim, LLP

(57) ABSTRACT

A developing apparatus. The developing apparatus includes a mainframe to hold a photosensitive medium and includes an opened top surface and a bottom surface with a photosensitive medium opening through which some part of the photosensitive medium is exposed, the mainframe to include two spaces formed at each side of the photosensitive medium that can receive toner and used toner, respectively; and a cover to cover the top surface of the mainframe.

11 Claims, 4 Drawing Sheets

DEVELOPING APPARATUS AND IMAGE FORMING APPARATUS HAVING THE SAME

CROSS-REFERENCE TO RELATED APPLICATIONS

This application claims priority under 35 U.S.C. §119(a) from Korean Patent Application No. 2006-95103 filed Sep. 28, 2006 in the Korean Intellectual Property Office, the disclosure of which is incorporated herein in its entirety by reference.

BACKGROUND OF THE INVENTION

1. Field of the Invention

The present general inventive concept relates to an image forming apparatus. More particularly, the present general inventive concept relates to a developing apparatus to develop images and an image forming apparatus having the same.

2. Description of the Related Art

A conventional image forming apparatuses forms images on a printing medium and includes a developing apparatus to form electrostatic latent images, according to a printing order, and then, develops the electrostatic latent images into images on the printing medium using toner.

FIG. 1 illustrates a conventional developing apparatus.

Referring to FIG. 1, a conventional developing apparatus 1 includes a mainframe assembly 10 to hold a photosensitive medium 12 on which images are formed, a cleaning assembly 20 to remove used toner from the photosensitive medium 12, and a cover 30.

The mainframe assembly 10 includes a mainframe 11, a photosensitive medium 12, a developing roller 13, a toner regulating member 14, left and right side plates 31 and 32, and a sealing member 16.

The mainframe 11 is formed to hold the photosensitive medium 12, the developing roller 13, the toner regulating member 14, and has opposite opened sides. Each of the opposite opened sides is closed by the left and right side plates 31 and 32. The left and right side plates 31 and 32 support the photosensitive medium 12 and the developing roller 13 to rotate.

The photosensitive medium 12 is rotatably disposed at a lower portion of the mainframe 11, and electrostatic latent images are formed on a surface of the photosensitive medium 12 by a laser beam emitted from an exposure unit (not illustrated). A charging roller 15 is disposed above the photosensitive medium 12 to charge the photosensitive medium 12.

The developing roller 13 is disposed at a side of the photosensitive medium 12 to supply with toner, thereby developing electrostatic latent images formed on the photosensitive medium 12. The toner regulating member 14 is disposed in contact with the developing roller 13 to regulate an amount of toner that is supplied by the developing roller 13. Toner is stored in a space 17 between the toner regulating member 14 and the mainframe 11. The sealing member 16 is disposed between the mainframe 11 and the cover 30 to protect toner from leaking from the mainframe 11.

The cleaning assembly 20 includes a cleaning frame 21 and a cleaning member 23. The cleaning member 23 is disposed at the cleaning frame 21 to remove used toner remaining on the surface of the photosensitive medium 12. The cleaning frame 21 has an inner space that receives the used toner removed by the cleaning member 23.

Hereinafter, an operation of the conventional developing apparatus 1 having a structure as described above will be described.

When a printing operation starts, the charging roller 15 applies a predetermined voltage to the surface of the photosensitive medium 12. When the photosensitive medium 12 receives power from a power transmitting unit (not illustrated) to rotate, a laser beam emitted from the exposure unit (not illustrated) forms electrostatic latent images on the charged surface of the photosensitive medium 12.

When the photosensitive medium 12 continues to rotate, toner supplied by the developing roller 13 develops the electrostatic latent images into images. At this time, toner is stored in the space 17 of the mainframe 11 at a side of the developing roller 13.

A transferring unit (not illustrated) transfers the images onto a printing medium supplied by a printing medium feed unit (not illustrated). When images are transferred onto a printing medium by the transferring unit, some of toner that forms the images may not be transferred onto the printing medium so as to remain on the surface of the photosensitive medium 12. The toner remaining on the surface of the photosensitive medium 12 is referred to as used toner. The used toner that remains on the photosensitive medium 12 is removed from the photosensitive medium 12 by the cleaning member 23, and then, is collected in the inner space of the cleaning frame 21. The photosensitive medium 12 having used toner removed is re-charged by the charging roller 15, and then, repeats the above described procedure.

After transferring the toner onto the photosensitive medium 12, the developing apparatus 1 uses the cleaning assembly 20 to clean the used toner remaining on the surface of the photosensitive medium 12. Accordingly, the photosensitive medium 12 is cleaned well so that it can produce good quality images in the future.

However, in the conventional developing apparatus 1, the cleaning assembly 20 that removes used toner and holds the removed used toner is formed in an independent part with respect to the mainframe assembly 10 that stores and supplies toner. In other words, the mainframe 11 to hold toner and the cleaning frame 21 to hold the used toner are separately formed. As a result, the cleaning assembly 20 is assembled during a separate assembly process from an assembly process of the mainframe assembly 10.

To form the cleaning assembly 20, the conventional developing apparatus 1 is provided with the cleaning frame 21 separated from the mainframe 11 thereby increasing a number of parts thereof.

Also, the cleaning assembly 20 is assembled into a subassembly through a separate assembly process, and then, is assembled with the mainframe assembly 10, thereby increasing assembling time. As a result, the conventional developing apparatus 1 has a high manufacturing cost.

SUMMARY OF THE INVENTION

The present general inventive provides a developing apparatus and an image forming apparatus having the same that can remove and hold used toner, and has a low manufacturing cost.

Additional aspects and utilities of the present general inventive concept will be set forth in part in the description which follows and, in part, will be obvious from the description, or may be learned by practice of the general inventive concept.

The foregoing and/or other aspects and utilities of the present general inventive concept are achieved by providing a developing apparatus, which includes a mainframe to hold a photosensitive medium and includes an open top surface and a bottom surface with a photosensitive medium opening through which some part of the photosensitive medium is exposed, the mainframe including two spaces formed at each side of the photosensitive medium to receive toner and used toner, respectively, and a cover to cover the top surface of the mainframe.

The developing apparatus may further include a developing member disposed at a side of the photosensitive medium to supply toner to the photosensitive medium, and a toner regulating member disposed to contact the developing member, wherein the developing member, the toner regulating member, and the mainframe form a toner space to hold the toner.

The developing apparatus may further include a cleaning member disposed opposite to the developing member to remove used toner from the photosensitive medium, wherein the cleaning member and the mainframe form a used toner space to hold the used toner removed from the photosensitive medium.

The cleaning member may be supported by the mainframe.

The developing apparatus may further include a sealing member disposed between the mainframe and the cover.

The foregoing and/or other aspects and utilities of the present general inventive concept may also be achieved by providing a developing apparatus, including a photosensitive medium, a mainframe including an open top surface, a bottom surface with a photosensitive medium opening through which some part of the photosensitive medium is exposed, openings formed at each side of the mainframe to correspond to opposite ends of the photosensitive medium, and two spaces respectively formed at the left and the right of the photosensitive medium, left and right side plates disposed to close each of the openings to rotatably support a shaft of the photosensitive medium, a cover to cover the top surface of the mainframe, and a cleaning member disposed at a side of the mainframe to remove used toner remaining on the photosensitive medium.

The developing apparatus may further include a developing member disposed at a side of the photosensitive medium and rotatably supported by the left and right side plates to supply toner to the photosensitive medium, and a toner regulating member disposed at the mainframe to contact the developing member, wherein the toner is stored at a toner space formed by the developing member, the toner regulating member, and the mainframe.

The cleaning member may be disposed opposite to the developing member, and the used toner removed from the photosensitive medium may be collected at a used toner space formed by the cleaning member and the mainframe.

The openings may have a size large enough to expose the photosensitive medium and the toner space.

The developing apparatus may further include a charging member to charge the photosensitive medium, and a toner supplying member to supply the toner to the developing member, wherein the left and right side plates rotatably support a shaft of the charging member and a shaft of the toner supplying member.

The developing apparatus may further include a sealing member disposed between the mainframe and the cover.

The foregoing and/or other aspects and utilities of the present general inventive concept may also be achieved by providing an image forming apparatus, including a printing medium feeding unit to feed a printing medium, a developing apparatus to form images corresponding to printing data, including a photosensitive medium, a mainframe including an opened top surface, a bottom surface with a photosensitive medium opening through which some part of the photosensitive medium is exposed, openings formed at each side of the mainframe to correspond to opposite ends of the photosensitive medium, and two spaces formed at the left and right of the photosensitive medium, left and right side plates disposed to close each of the openings and to rotatably support a shaft of the photosensitive medium; a cover to cover the top surface of the mainframe, and a cleaning member disposed at a side of the mainframe to remove used toner remaining on the photosensitive medium, and a transferring unit to transfer images on the photosensitive medium onto a printing medium.

The foregoing and/or other aspects and utilities of the present general inventive concept may also be achieved by providing a developing apparatus with a mainframe, the developing apparatus including a single monolithic mainframe having a first section to receive new toner, a second section to receive used toner, a third section to transfer the new toner from the first section to the second section, wherein the new toner becomes the used toner, and a photosensitive medium located in the third section to use the new toner to transfer an electrostatic latent image corresponding to the printing data onto the printing medium, and a cover coupled to the single monolithic mainframe to cover the first, second, and third sections.

The third section may separate the first section from the second section.

The developing apparatus may further include a cleaning member disposed between the second section and the third section to transfer the used toner from the photosensitive medium to the second section.

The developing apparatus may further include first and second openings respectively disposed at both ends of the photosensitive medium, and first and second side plates to removably cover the first and second openings, respectively.

The foregoing and/or other aspects and utilities of the present general inventive concept may also be achieved by providing an image forming apparatus, including a printing medium feeding unit to feed a printing medium, a developing apparatus to form images corresponding to printing data and having a mainframe, the developing apparatus including a single monolithic mainframe having a first section to receive new toner, a second section to receive used toner, a third section to transfer the new toner from the first section to the second section, wherein the new toner becomes the used toner, and a photosensitive medium located in the third section to use the new toner to transfer an electrostatic latent image corresponding to the printing data onto the printing medium, and a cover coupled to the single monolithic mainframe to cover the first, second, and third sections, and a fixing unit to fix the images onto the printing medium.

The image forming apparatus may further include a cleaning member disposed between the second section and the third section to transfer the used toner from the photosensitive medium to the second section.

BRIEF DESCRIPTION OF THE DRAWINGS

These and/or other aspects and utilities of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
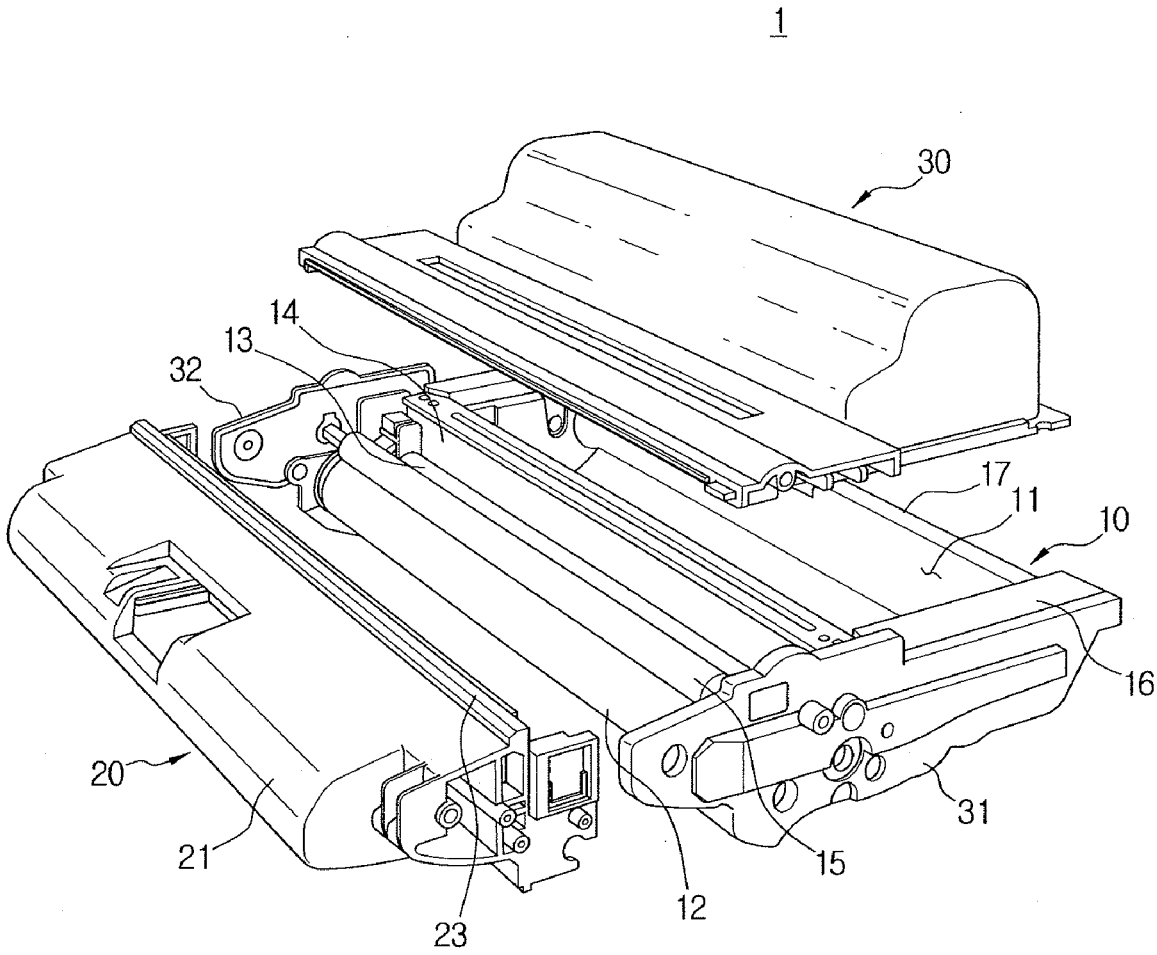
FIG. 1 (PRIOR ART)
FIG. 1 is an exploded perspective view illustrating a conventional developing apparatus.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

Figure 2:
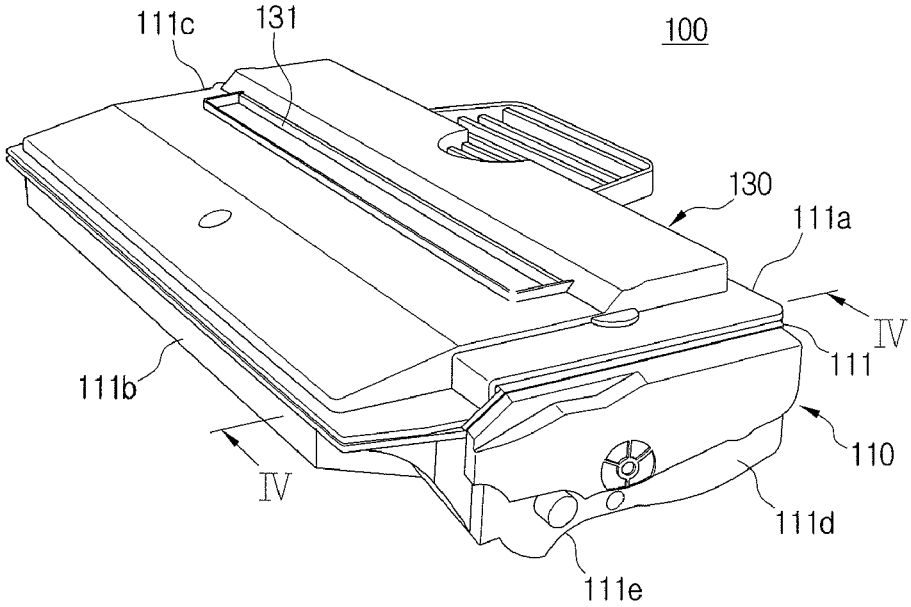
FIG. 2 is a perspective view illustrating a developing apparatus according to an embodiment of the present general inventive concept.
Figure 3:
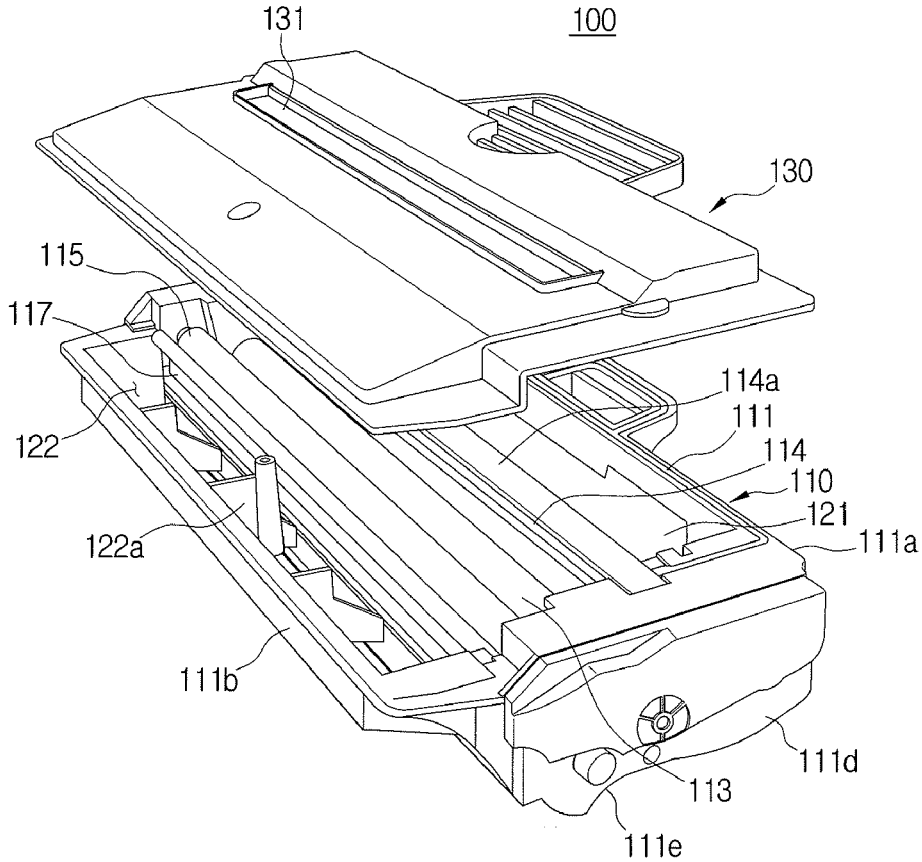
FIG. 3 is an exploded perspective view illustrating the developing apparatus of FIG. 2.

Referring to FIGS. 2 and 3, a developing apparatus 100 according to an embodiment of the present general inventive concept includes a mainframe assembly 110 and a cover 130.

Figure 4:
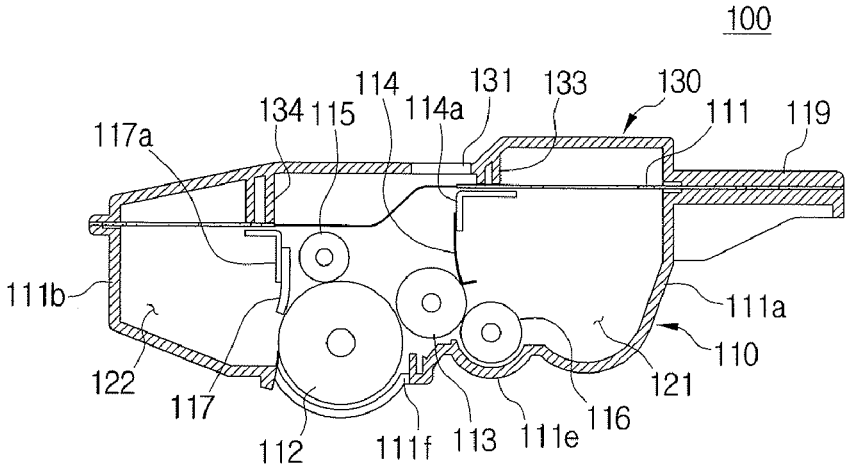
FIG. 4 is a sectional view schematically illustrating the developing apparatus of FIG. 2 taken along a line IV-IV as illustrated in FIG. 2.

Referring to FIGS. 3 and 4, the mainframe assembly 110 stores toner and holds a photosensitive medium 112 on which images are formed. The mainframe assembly 110 includes a mainframe 111, a photosensitive medium 112, a developing member 113, a toner regulating member 114, a cleaning member 117, and a sealing member 119.

The mainframe 111 is formed in a substantially rectangular tank shape with a bottom surface to hold the photosensitive medium 112, the developing member 113, the toner regulating member 114, and the cleaning member 117. Accordingly, the mainframe 111 has an opened top surface, a bottom surface 111*e*, and four side surfaces 111*a*, 111*b*, 111*c*, and 111*d*, respectively. The side surfaces 111*a* and 111*b* which are parallel to the photosensitive medium 112 are referred to as a front surface and a back surface, respectively. The side surfaces 111*c* and 111*d* that support the photosensitive medium 112 to rotate are referred to as a left surface and a right surface, respectively. Accordingly, in FIG. 3, a side surface 111*a* in the right of the photosensitive medium 112 is referred to as a front surface, a side surface 111*b* in the left thereof is referred to as a back surface, and a side surface 111*d* in front thereof is referred to as a right surface.

The bottom surface 111*e* of the mainframe 111 is formed in a proper shape to allow the developing apparatus 100 to perform functions of holding toner and supplying toner to the photosensitive medium 112. Also, the bottom surface 111*e* of the mainframe 111 is formed in a shape corresponding to a structure of an image forming apparatus 200 (see FIG. 6) where the developing apparatus 100 can be mounted.

The bottom surface 111*e* of the mainframe 111 includes a photosensitive medium opening 111*f* through which a portion of the photosensitive medium 112 is exposed to transfer an image to a printing medium. The photosensitive medium opening 111*f* is formed in such a way that the photosensitive medium 112 is exposed in a lengthwise direction thereof. The photosensitive medium 112 is rotatably supported by the left and right surfaces 111*c* and 111*d*. As a result, the mainframe 111 is divided into two spaces 121 and 122 by the photosensitive medium 112. Toner is stored at the space 121 between the front surface 111*a* of the mainframe 111 and the photosensitive medium 112, where the developing member 113 to supply toner stored therein to the photosensitive medium 112 is disposed. The cleaning member 117 is disposed at the space 122 between the back surface 111*b* of the mainframe 111 and the photosensitive medium 112, where used toner removed from the photosensitive medium 112 by the cleaning member 117 is collected. Accordingly, the mainframe 111 is formed in a single piece, and is provided with the first space 121 to hold toner and the second space 122 to hold used toner separated each other therein.

The developing member 113 is rotatably disposed and adjacent to the photosensitive medium 112 inside the mainframe 111. According to a developing method of toner, the developing member 113 may be disposed in contact with the photosensitive medium 112. Alternatively, the developing member 113 may be disposed apart from the photosensitive medium 112. In this embodiment of the present general inventive concept, a developing roller is used as the developing member 113.

The toner regulating member 114 is disposed in contact with the developing member 113 to regulate a height of a toner layer conveyed by the developing member 113 and to charge toner by a friction force. The toner regulating member 114 is formed in a substantially plate shape and is fixed to the left and right surfaces 111*c* and 111*d* of the mainframe 111 via a toner regulating member fixture 114*a*. Toner is stored at the first space 121 (hereinafter, referred to as a toner space) between the toner regulating member 114, the developing member 113, and the front surface 111*a* of the mainframe 111. At this time, a toner supplying member 116 to supply toner and an agitator (not illustrated) to agitate toner may be disposed at the toner space 121. The toner supplying member 116 may be rotatably disposed to contact the developing member 113 at a lower portion of the toner space 121.

The cleaning member 117 is disposed opposite to the developing member 113 to remove used toner remaining on the surface of the photosensitive medium 112. The cleaning member 117 is formed in a substantially plate shape and is fixed to the left and right surfaces 111*c* and 111*d* of the mainframe 111 via a cleaning member fixture 117*a*. Used toner that is removed from the surface of the photosensitive medium 112 by the cleaning member 117 is received in the second space 122 (hereinafter, referred to as a used toner space) between the cleaning member 117 and the back surface 111*b* of the mainframe 111. A plurality of supporting ribs 122*a* may be disposed in the used toner space 122 to prevent the mainframe 111 from being deformed.

The charging member 115 is disposed between the developing member 113 and the cleaning member 117. The charging member 115 is rotatably disposed in contact with the photosensitive medium 112 to charge the surface of the photosensitive medium 112 by a predetermined voltage.

A power transmitting unit (not illustrated) is disposed at the left surface 111*c* of the mainframe 111 to transmit a power to each of the photosensitive medium 112, the developing member 113, the toner supplying member 116, and the charging member 115 to rotate.

The cover 130 can cover the top surface of the mainframe 111 to protect the photosensitive medium 112, the developing member 113, the charging member 115, etc. Also, the sealing member 119 is disposed between the top surface of the mainframe 111 and the cover 130. The sealing member 119 can tightly close an upper part of the toner space 121 and an upper part of the used toner space 122. As a result, toner stored in the toner space 121 of the mainframe 111 and used toner in the used toner space 122 thereof cannot leak out. The cover 130 includes a beam hole 131 through which a laser beam emitted from an exposure unit 230 (see FIG. 6) passes to reach the photosensitive medium 112. Also, first and second supporting members 133 and 134 may be included inside the cover 130 to support the toner regulating member 114 and the cleaning member 117 when the cover 130 is assembled with the mainframe 111.

Hereinafter, an operation of a developing apparatus 100 according to an exemplary embodiment of the present general inventive concept having the above described structure is described.

When a printing operation begins, a charging member 115 charges a portion of the surface of a photosensitive medium 112 by a predetermined voltage. When the photosensitive medium 112 rotates, a laser beam emitted from an exposure unit 230 (see FIG. 6) passes through a beam hole 131 of a cover 130 and forms electrostatic latent images corresponding to printing data on a surface of the photosensitive medium 112. When the photosensitive medium 112 keeps rotating, the electrostatic latent images on the photosensitive medium 112 face to a developing member 113.

In contrast, a toner supplying member 116 which is disposed at the toner space 121 rotates to supply toner that is stored at the toner space 121 to a surface of the developing member 113. When the developing member 113 rotates, the toner that is attached on the surface of the developing member 113 is regulated into a thin toner layer by the toner regulating member 114, and is conveyed to the photosensitive medium 112. When the developing member 113 continues to rotate so that the toner is conveyed to face the photosensitive medium 112, the toner on the developing member 113 is moved to the photosensitive medium 112 by an electrical force that operates between the electrostatic latent images on the photosensitive medium 112 and the developing member 113, and then, develops the electrostatic latent images into images.

When the photosensitive medium 112 continues to rotate, images on the photosensitive medium 112 are exposed to the outside of the mainframe 111 through the photosensitive medium opening 111*f*. Accordingly, the images on the photosensitive medium 112 are transferred onto a printing medium by a transferring unit 240 (see FIG. 6) that is disposed under the photosensitive medium 112. Some of the toner that forms the images may not transfer to the printing medium and may remain on the surface of the photosensitive medium 112 as used toner.

When the photosensitive medium 112 continues to rotate, the used toner is removed by the cleaning member 117, and thus, is collected inside the used toner space 122. When the photosensitive medium 112 continues to rotate, as described above, the surface of the photosensitive medium 112 is charged again by the charging member 115, and then, the above procedure is repeated to perform a printing operation.

In summary, the developing apparatus 100 of FIGS. 2 through 4 according to an embodiment of the present general inventive concept includes the toner space 121 where toner to form images is stored and the used toner space 122 where used toner removed from the photosensitive medium 112 is collected. The toner space 121 and the used toner space 122 are separately formed at both sides of the photosensitive medium 112 disposed at the mainframe 111. Therefore, the developing apparatus 100 may develop electrostatic latent images on the photosensitive medium 112 into images, remove used toner remaining on the photosensitive medium 112, and collect the used toner in the used toner space 122.

Figure 5:
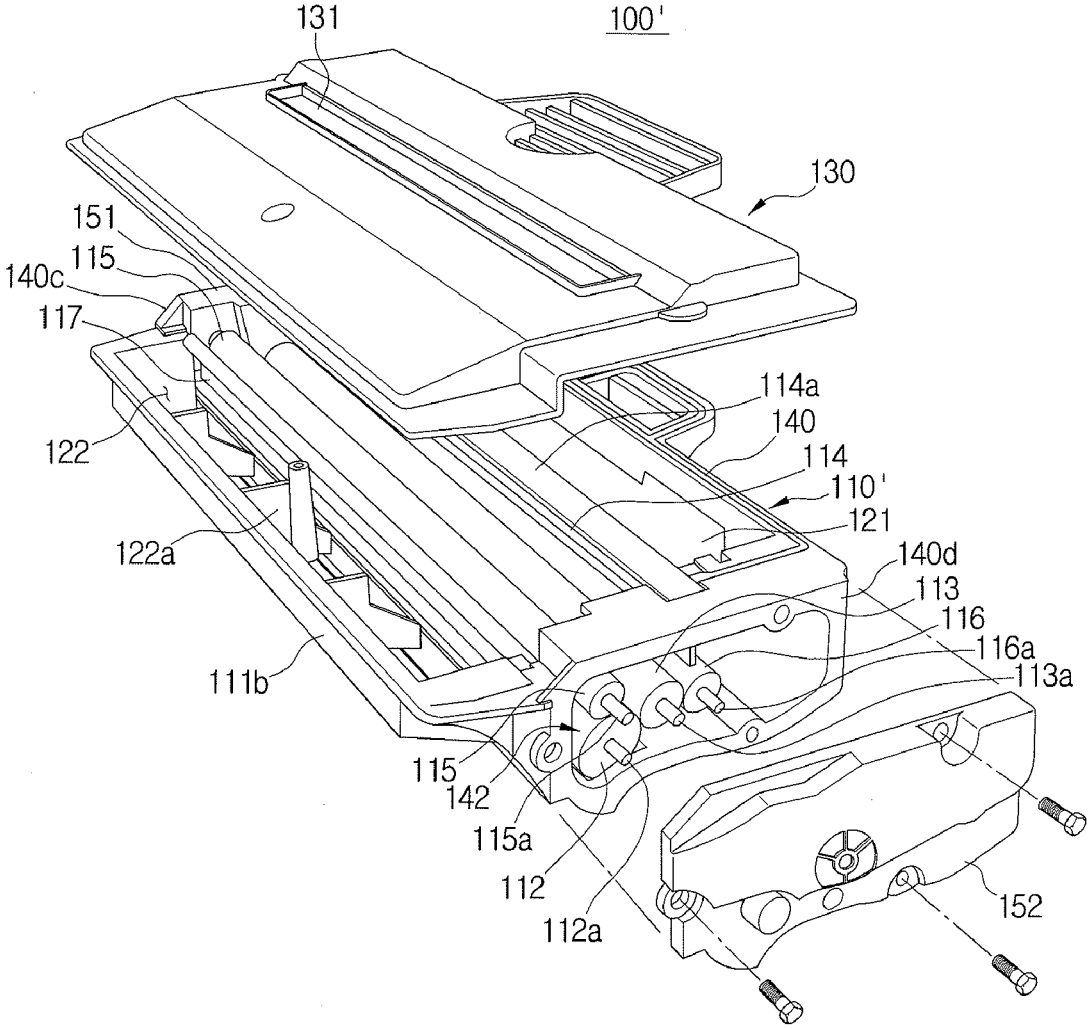
FIG. 5 is an exploded perspective view illustrating a developing apparatus according to another embodiment of the present general inventive concept.

FIG. 5 illustrates a developing apparatus according to another embodiment of the present general inventive concept.

Referring to FIG. 5, a developing apparatus 100' according to another embodiment includes a mainframe assembly 110' and a cover 130.

The mainframe assembly 110' stores toner and holds a photosensitive medium 112 on which images are formed. The mainframe assembly 110' includes a mainframe 140, a photosensitive medium 112, a developing member 113, a toner regulating member 114, a cleaning member 117, and a sealing member 119.

The mainframe 140 is substantially similar to the mainframe 111 of the developing apparatus 100 according to the above-described embodiment. However, the mainframe 140 includes openings 142 (FIG. 5 only illustrates a right opening) formed at a left surface 140*c* and a right surface 140*d* thereof which are different from the mainframe 111 of the above-described embodiment. The left and right openings 142 may be as large as the photosensitive medium 112, the developing member 113, the toner supplying member 116, the charging member 115, and the toner space 121 can be exposed. Also, the left and right openings 142 are respectively closed by a left side plate 151 and a right side plate 152. The left side plate 151 and the right side plate 152 prevent stored toner from leaking out from through the left and right openings 142. Also, although not illustrated, the left and right openings 142 may be as large the used toner space 122 (see FIG. 4).

In contrast, the left and right side plates 151 and 152 are configured to rotatably support a shaft 112*a* of the photosensitive medium 112, a shaft 113*a* of the developing member 113, a shaft 116*a* of the toner supplying member 116, and a shaft 115*a* of the charging member 115. Therefore, the photosensitive medium 112, the developing member 113, the charging member 115, and the toner supplying member 116 are disposed inside the mainframe 111 and are rotatably supported by the left and right side plates 151 and 152. However, the toner regulating member 114 and the cleaning member 117 are supported by the left and right surfaces 140*c* and 140*d* of the mainframe 140. To assemble the developing apparatus 100' may be easy because of the openings 142 which are formed at the left and right surfaces 140*c* and 140*d* of the mainframe 140 allow easy access into the mainframe 140. Furthermore, the left and right side plates 151 and 152 close the openings 142 and rotatably support the photosensitive medium 112, the developing member 113, the charging member 115, and the toner supplying member 116, thereby making interchanging of parts easier. Also, a dimension of gaps between the photosensitive medium 112, the developing member 113, the charging member 115, and the toner supplying member 116 may be determined more precisely.

In the above description, the mainframe 140 includes an opening 142 at each of the left and right surfaces 140*c* and 140*d* thereof. Alternatively, the mainframe may have a structure that includes an opening at either of the left and right side surfaces to be closed by a side plate.

A structure of the photosensitive medium 112, the developing member 113, the toner regulating member 114, the cleaning member 117, and the sealing member 119 and an operation of the developing apparatus 100' according to the embodiment of FIG. 5 are substantially the same as the developing apparatus 100 of FIGS. 2 through 4. Therefore, detailed descriptions thereof are omitted.

Hereinafter, an example of an image forming apparatus employing a developing apparatus according to an embodiment of the present general inventive concept will be explained.

Figure 6:
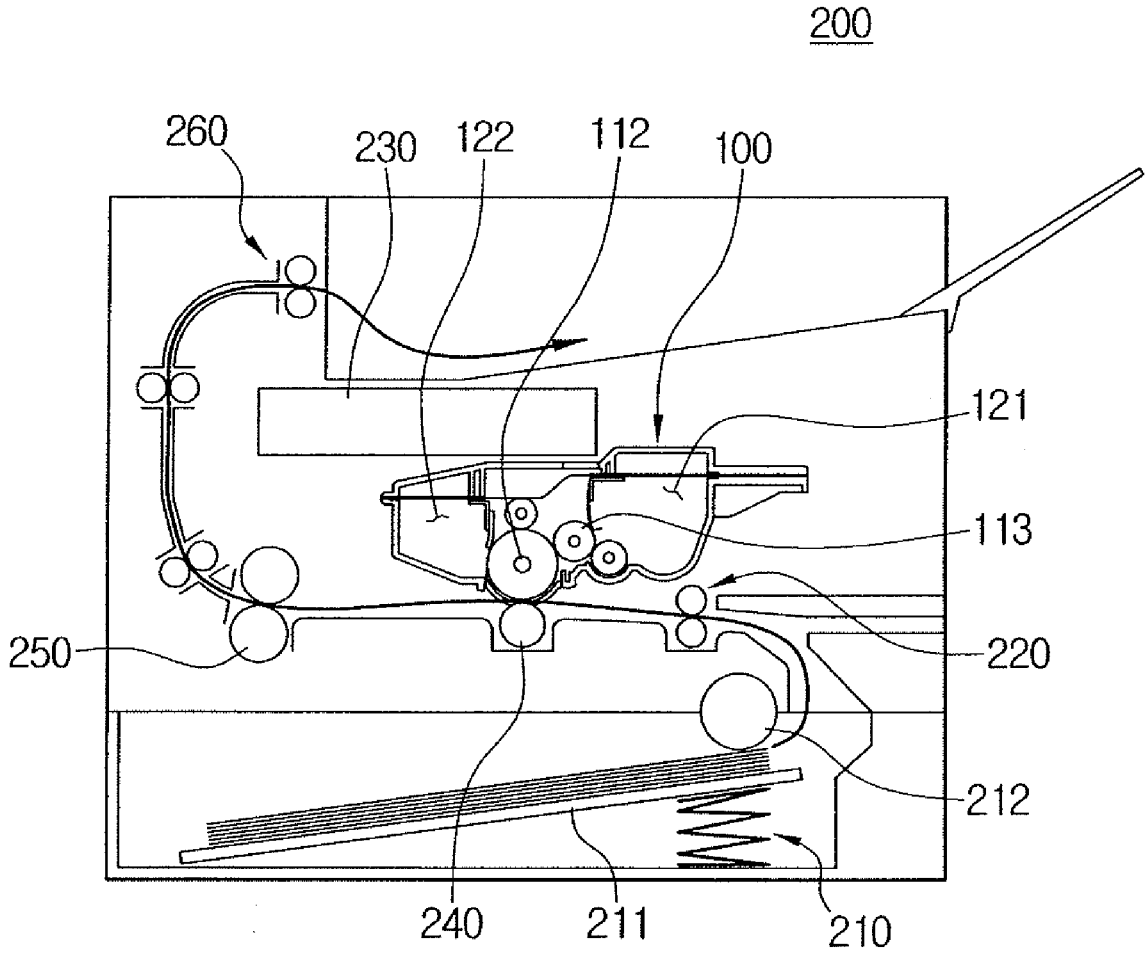
FIG. 6 is a sectional view schematically illustrating an image forming apparatus having a developing apparatus according to an embodiment of the present general inventive concept.

Referring to FIG. 6, an image forming apparatus 200 according to an embodiment of the present general inventive concept includes a printing medium feeding unit 210, a printing medium moving unit 220, a developing apparatus 100, a transferring unit 240, an exposure unit 230, a fixing unit 250, and a discharging unit 260.

The printing medium feeding unit 210 is disposed at a lowermost portion of the image forming apparatus 200, and picks up printing media stored at a printing medium cassette 211 one by one using a pick-up roller 212 to feed the printing medium to the printing medium moving unit 220. The printing medium moving unit 220 moves the printing medium fed from the printing medium feeding unit 210 to a position between a photosensitive medium 112 of the developing apparatus 100 and the transferring unit 240.

The developing apparatus 100 forms predetermined images corresponding to printing data and is described above in detail. Therefore, a detailed description thereof is omitted.

The exposure unit 230 emits a laser beam corresponding to printing data to form predetermined electrostatic latent images on the photosensitive medium 112 of the developing apparatus 100.

The transferring unit 240 is disposed to face the photosensitive medium 112 of the developing apparatus 100 to transfer images formed on the photosensitive medium 112 onto a printing medium. The fixing unit 250 uses heat and pressure to fix the images transferred onto the printing medium when the printing medium passes through between the photosensitive medium 112 and the transferring unit 240. The discharging unit 260 discharges the printing medium to outside the image forming apparatus 200 after the printing medium passes through the fixing unit 250 and the images are fixed onto the printing medium.

The image forming apparatus 200 according to an embodiment of the present general inventive concept further includes a control part (not illustrated) to control each of the above-described elements to perform a printing operation and an electric power part (not illustrated) to apply a predetermined voltage to each of the elements.

The printing medium feeding unit 210, the printing medium moving unit 220, the transferring unit 240, the fixing unit 250, the discharging unit 260, the control part, and the electric power part are substantially similar to those of the conventional image forming apparatus. Therefore, detailed descriptions thereof are omitted.

When the control part of the image forming apparatus 200 having the above-described structure receives a printing order from a host connected to the image forming apparatus 200, the control part controls the pickup roller 212 of the printing medium feeding unit 210 to pick up a printing medium from the printing medium cassette 211 and to feed the printing medium to the printing medium moving unit 220. At the same time, the control part controls the exposure unit 230 to emit a laser beam corresponding to printing data. The laser beam forms electrostatic latent images corresponding to the printing data on the photosensitive medium 112 of the developing apparatus 100. When the photosensitive medium 112 rotates, toner that is supplied by the developing member 113 develops the electrostatic latent images into images. The procedure that the developing member 113 supplies the photosensitive medium 112 with toner and develops electrostatic latent images is described above. Therefore, a detailed description thereof is omitted.

The printing medium moving unit 220 moves a printing medium to a position between the photosensitive medium 112 and the transferring unit 240. Accordingly, the transferring unit 240 transfers images on the photosensitive medium 112 onto the printing medium. At this time, some of the toner is not transferred to the printing medium and remains on the surface of the photosensitive medium 112 as used toner. The used toner is removed from the surface of the photosensitive medium 112 by the cleaning member 117 and is collected at the used toner space 122 of the developing apparatus 100.

When the printing medium (with images transferred thereon) passes through the fixing unit 250, the images are fixed onto the printing medium. After that, the printing medium (with images fixed thereon) is discharged to outside the image forming apparatus 200 by the discharging unit 260, to complete a printing operation.

A developing apparatus according to an embodiment of the present general inventive concept includes a cleaning member to remove used toner, a used toner space where removed used toner is collected, and a toner space where toner to form images is stored which are all formed at a mainframe so that a separate cleaning assembly to remove used toner from the photosensitive medium is not required. As a result, a number of parts and an assembling time of the developing apparatus may decrease to accordingly decrease a manufacturing cost of the developing apparatus.

Furthermore, when the manufacturing cost of the developing apparatus according to an embodiment of the present general inventive concept decreases, a manufacturing cost of the image forming also may decrease.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. A developing device comprising:

a mainframe formed of a single monolithic piece including a first portion to define a waste toner space, a second portion to define a new toner space, a third portion disposed between the first portion and the second portion to define a middle space, and an open top defined by the first portion, the second portion, and the third portion;

a photosensitive medium installed in the third portion of the single monolithic piece;

a toner supplying member installed in the second portion of the single monolithic piece; and a cover coupled to the mainframe to cover the open top, wherein the second portion of the single monolithic piece is directly extended from the third portion of the single monolithic piece.

2. The developing device of claim 1, wherein the first portion is directly extended from the third portion in a direction opposite to the second portion with respect to the third portion.

3. The developing device of claim 1, wherein the single monolithic piece forms a bottommost surface of the developing device to define the waste toner space, the new toner space and the middle space.

4. The developing device of claim 1, wherein the second portion includes a plurality of rounded portions to receive the toner supplying member and toner in the new toner space.

5. The developing device of claim 1, further comprising:

a developing member adjacent one side of the photosensitive medium;

a toner regulating member disposed between the third portion and the second portion in contact with the developing member and fixed to the mainframe via a toner regulating member fixture, wherein the cleaning member and the single mainframe form the used toner space to hold the used toner removed from the photosensitive medium.

6. The developing device of claim 5, further comprising:

a support member formed of a same piece as the cover to be positioned adjacent the toner regulating member fixture to support the toner regulating member.

7. The developing device of claim 1, further comprising:

a cleaning member disposed between the first portion and the third portion and fixed to the mainframe by a cleaning member fixture; and a support member formed of a same piece as the cover the cover to be positioned adjacent the cleaning member fixture to support the cleaning member.

8. The developing device of claim 1, further comprising:

openings defined by the single monolithic piece and formed at each side of the mainframe to correspond to opposite ends of the photosensitive medium;

side plates to detachably close the openings and rotatably support a shaft of the photosensitive medium.

9. The developing device of claim 8, wherein the openings have a size large enough to expose the photosensitive medium and the new toner space.

10. The developing device of claim 8, further comprising:

a charging member to charge the photosensitive medium, wherein the side plates rotatably support a shaft of the charging member and a shaft of the toner supplying member.

11. The developing device of claim 1, further comprising:

a first extended portion of the single monolithic piece disposed external to the new toner space;

a second extended portion of the cover to correspond to the first extended portion; and a sealing member disposed between the first extended member and the second extended member.

* * * * *